United States Patent [19]

Watkins

[11] Patent Number: 4,491,439

[45] Date of Patent: Jan. 1, 1985

[54] TENDON LATCH

[75] Inventor: Bruce J. Watkins, Palos Verdes, Calif.

[73] Assignee: Hughes Tool Company, Houston, Tex.

[21] Appl. No.: 402,179

[22] Filed: Jul. 26, 1982

[51] Int. Cl.[3] ..... E02D 5/74; E02D 21/00; E21B 43/013; E21B 43/36

[52] U.S. Cl. ..... 405/224; 405/169; 405/195; 166/340; 166/341

[58] Field of Search ..... 405/169, 170, 202, 195, 405/224; 166/340, 341, 349; 285/18, 315

[56] References Cited

U.S. PATENT DOCUMENTS

| | | | |
|---|---|---|---|
| 3,222,088 | 12/1965 | Haeber | 285/315 X |
| 3,223,164 | 12/1965 | Otteman | 166/340 |
| 3,321,217 | 5/1967 | Ahlstone | 166/340 X |
| 3,452,815 | 7/1969 | Watkins . | |
| 3,492,027 | 1/1970 | Herring . | |
| 3,675,713 | 7/1972 | Watkins | 166/340 |
| 3,851,708 | 12/1974 | Ellis | 285/315 X |
| 4,086,776 | 5/1978 | Beard | 166/341 X |
| 4,333,528 | 6/1982 | Woodman . | |
| 4,405,016 | 9/1983 | Best | 166/340 X |

*Primary Examiner*—Dennis L. Taylor
*Assistant Examiner*—Nancy J. Stodola
*Attorney, Agent, or Firm*—Robert A. Felsman; James E. Bradley

[57] ABSTRACT

A latch connects tendons run from a floating platform to a socket in a foundation on the sea floor. The latch includes a latch body having a plurality of dogs disposed within and urgible outward from the latch body. A piston is releasably disposed within the latch body above the dogs and moves downwardly when released to urge the dogs outwardly from the body into latching engagement with the socket. A trigger mechanism in the latch releases the piston when the latch body lands in the socket and contacts a trigger pin projecting upwardly from the bottom of the socket. A series of wedges are disposed exteriorally on the body and inhibit lateral movement of the body relative to the socket when the tendon is subjected to a cycle bending loads.

18 Claims, 3 Drawing Figures

TENDON LATCH

FIELD OF THE INVENTION

The present invention generally relates to the connecting of a floating tension leg platform to a subsea anchor base, and more specifically relates to the releasable connecting of tendons extending downwardly from the foating leg platform to sockets on the anchor base.

BACKGROUND OF THE INVENTION

One type of floating offshore production platform is the tension leg platform. This type of platform is anchored by tendons running from the platform to an anchor base or foundation on the sea floor. The connecting of the tendons to the foundation often presents difficult problems which are not always carried out by presently available equipment in satisfactory or efficient manner.

Additionally, the connection between the tendon and foundation is often subject to cycle bending loads as a result of wave and current action on the platform and tendons. This cycle bending stress tends to loosen the connection between the tendons and the foundation. Presently available equipment does not always deal with this cycle bending load in a satisfactory manner.

Furthermore, it is desirable to be able to quickly release the tendons from the anchor base to facilitate movement of the tension leg platform. Presently available equipment often does not provide for an efficient manner of rapidly releasing the tendons from the subsea anchor base.

Accordingly, it is the principle object of the pesent invention to quickly and efficiently connect tendons from a tension leg platform to a subsea anchor base.

It is a further object of this invention to quickly and efficiently disconnect the tendons from the anchor base.

It is another object of this invention to connect and disconnect tendons from a tension leg platform to a subsea anchor base with a mechanically simple arrangement.

Yet another object of this invention is to connect a tendon from a tension leg platform to a subsea anchor base in a manner resisting cycle bending loads and stresses placed on the connection between the tendons and the anchor base.

SUMMARY OF THE INVENTION

The present invention, in a broad aspect, provides a latch for connecting tendons run from a floating offshore platform to sockets in an anchor base on the sea floor. The latch includes a latch body, having a plurality of dogs disposed therein and urgible outward from the body. The dogs latchingly engage the socket. A piston, releasably disposed within the body above the dogs, moves downwardly when released to urge the dogs outwardly into latching engagement with the socket. A trigger releases the piston when the latch body lands in the socket. A series of wedges, disposed exteriorally on the body, inhibit lateral movement of the latch body relative to the socket in response to any bending stress.

In accordance with one feature of the invention, a plurality of retaining dogs, extending outwardly from the movable inwardly into the pistion, latchingly engage the latch body to prevent the downward movement of the piston until the retaining dogs are released.

The retaining dogs are maintained in engagement with the latch body by a flange resting upon a shoulder in the piston and suspending a shaft downwardly into a through-bore at the bottom of the latch body. When the latch lands in the socket, a trigger in the bottom of the socket makes contact with the shaft and urges the shaft and the flange upwardly. The upward movement of the flange releases the retaining dogs from engagement with the latch body, thereby allowing the piston to move downwardly to urge the latching dogs into engagement with the sockets.

In accordance with another feature of the present invention, a removal neck is attached to the piston and allows a tool to run through the tendon to latch upon and pull the piston upwardly to release the latching dogs from engagement with the socket. The upward movement of the piston moves the retaining dogs upwardly until urged into engagement with the latch body by the flange. The latch may thereafter be removed from the socket.

In accordance with another feature of the invention, the latch body includes a unidirectional valve to displace fluid from adjacent the wedges as both the latch lands in the socket and as water is purged from the latch body.

In accordance with yet another feature of the invention, the exterior wedges form two annular tapered rings about the latch body which engage tapered portions in the bore of the socket. The wedges are driven into place either by their own weight or by some other means as the tendons are subjected to cycle bending and prevent the latch from moving relative to the socket.

Other object, features, and advantages of the present invention will become apparent from a consideration of the following detailed description and the accompanying drawings.

DETAILED DESCRIPTION

Figure 1:
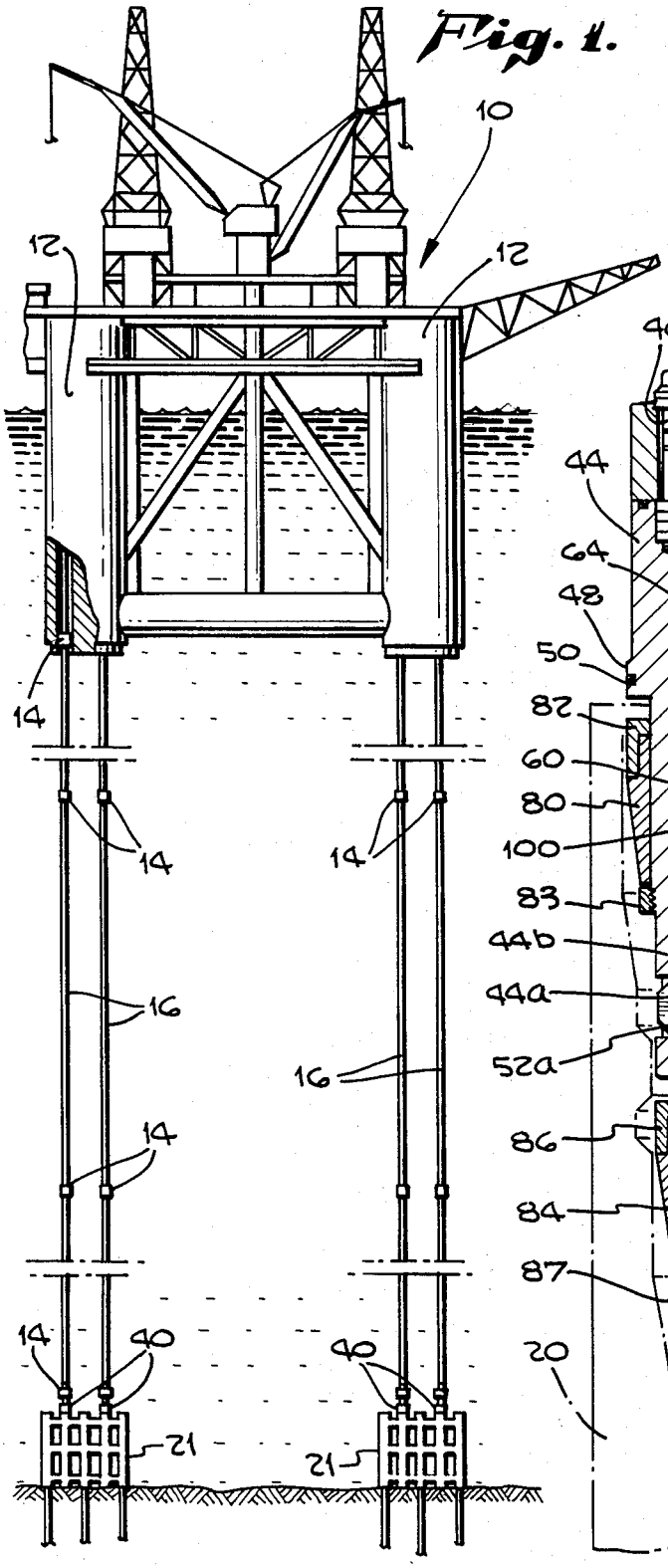
FIG. 1 shows a schematic view of a floating tension leg platform anchored to a subsea anchor base by the tendon latch of the present invention.

Referring more particularly to the drawings, FIG. 1 shows an offshore tension leg platform 10 anchored to a series of subsea anchor bases or foundations 21, by a series of tendons 16. The tendons 16 are interconnected by means of flex/reaction joints 14 to allow the flexure of the tendons in response to wave and current action. The tendons connect to legs 12 of the platform 10.

The tension leg platform derives its name from the fact that after the connection is made to the subsea foundation 21, the legs 12 of the platform are made bouyant, by means of air chambers or the like, to place the tendons 16 under tension.

Figure 2:
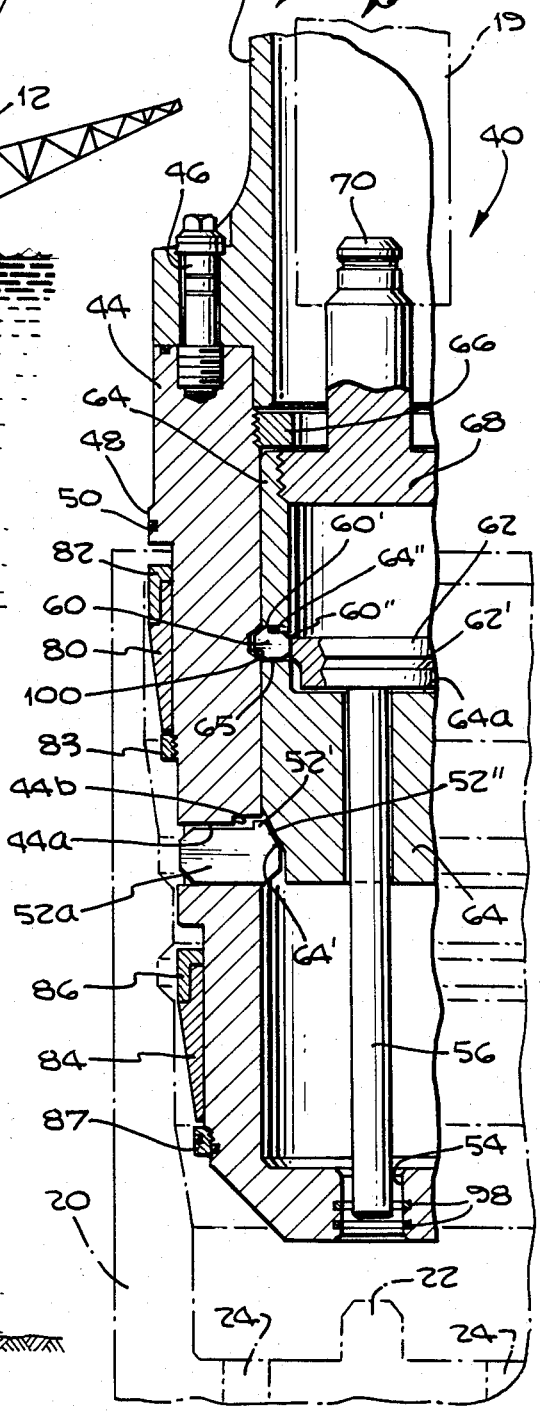
FIG. 2 shows an elevational view, partially in section, of the tendon latch prior to landing in the socket portion of the subsea anchor base.

The connection between the tendons 16 and the foundation 21 is made by a tendon latch 40 according to the present invention. The tendon latch 40 engages a socket 20, as shown in FIG. 2. As all of the tendon latches 40 in FIG. 1 are identical, only one will be discussed in detail for purposes of this invention.

Figure 3:
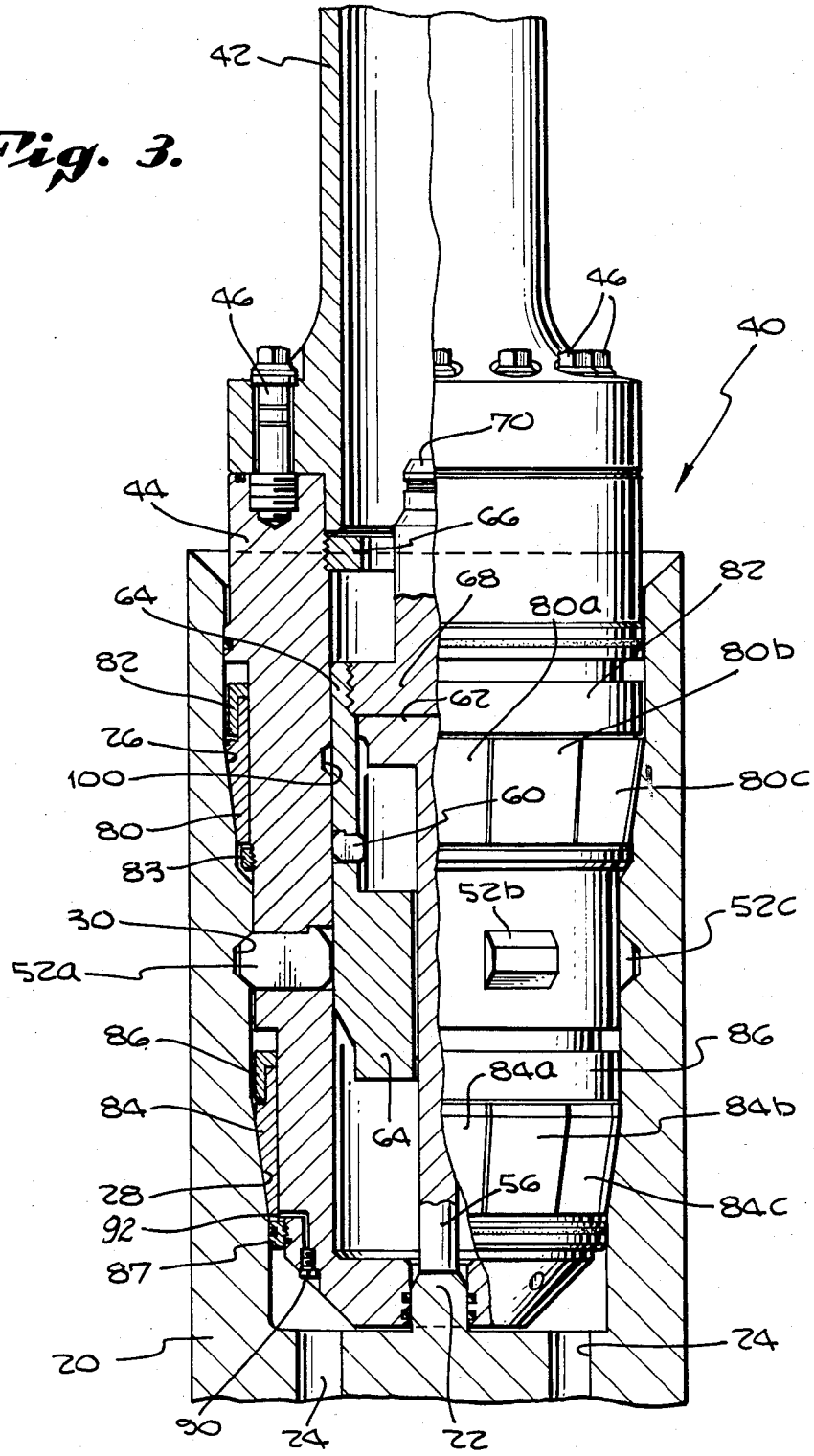
FIG. 3 shows an elevational view, partially in section, of the tendon latch after landing in and latching onto the socket.

Referring to FIG. 2, the tendon latch 40 includes an upper body 42 attached by bolts 46 or the like to a lower body 44. The upper body 42 is connected to the tendon 16 by conventional means. The lower body 44 includes a shoulder 48 having a circumferential seal 50. The body 44 includes a plurality of openings 44*a*, each having positioned therein a latch dog 52. Three such dogs 52*a, b, c,* are shown in FIG. 3. Each of the dogs 52 is provided with a shoulder 52' which engages a corresponding shoulder 44*b* in the openings 44*a*. Each of the dogs 52*a* is also provided with a cam surface 52" on its upper rear surface.

The lowermost portion of the lower body 44 is provided with an opening 54 having a plurality of seals 98 positioned therein. It is into this opening 54 that a trigger pin 22 on the socket 20 enters to cause engagement between the latch 40 and the socket 20.

Disposed about the exterior of the lower body 44 are two pluralities of wedges, 80 and 84, forming two segmented wedge rings. The upper wedge ring 80 is maintained on the outside of the latch body 44 by means of an floating upper collar 82 and an upper annular ring 83. The lower wedge ring 84 is maintained in position on the wedge body 44 by means of a lower floating collar 86 and a lower annular ring 87. These wedge rings 80 and 84 engage the interior of the socket 20 to resist lateral movement of the latch 40 in the socket 20 in response to cycle bending loads.

Disposed interiorally in the lower latch body 44 is a generally cylindrical and hollow piston 64 having a cam 64' disposed adjacent the cam surface 52" on the latch dogs 52. The piston 64 is provided with a plurality of openings 65 into which are inserted a series of retaining dogs 60, with each of the retaining dogs 60 having a shoulder 60' which engages a comparable shoulder 64" on the piston. Each of the retaining dogs 60 also includes a cam surface 60" on its upper back side. The retaining dogs 60 engage an annular recess 100 in the lower body 44.

Threadingly engaging the upper portion of the piston 64 is a flanged neck 68 provided with an annular groove 70 to engage a tool 19 inserted into the tendon 16 to effect removal of the latch as described hereinbelow. A collar 66 threaded onto the lower body 44 above the piston 64 facilitates disassembly of the latch.

Disposed interiorally within the piston 64 is a disk or flange 62 having a cam surface 62'. The flange 62 rests on a shoulder 64*a* in the piston. The flange 62 is attached to or formed integrally with a shaft 56, which is suspended downwardly into the opening 54 in the lower body 44.

The socket 20 into which the latch 40 is landed has a generally circular body with a trigger pin 22 projecting upwardly therefrom. The bore of the socket 20 is provided with an upper conical surface 26 and a lower conical surface 28 which respectively engage the upper and lower wedge rings 80 and 84 as described below. The bore of the socket 20 is also provided with an annular recess 30 which engages the latching dogs 52 when the latch 40 is latched to the socket.

The socket bore 20 is also provided with a plurality of vents 24 communicating with the sea to allow water to be pushed out of the socket 20 by the latch 40 as it enters the socket. The vents 24 are also used in the purging of water from the latch body after landing in the socket and in the forcing of oil through the latch body for corrosion protection, as described below. Cooperating with the vents 24 in a one-way valve 90, as known in the art, in the lower latch body 44 through which fluid adjacent the lower wedge ring 84 is passed. A passage 92 in the lower latch body 44 connects the area adjacent the lower wedge ring 84 and the one-way valve 90.

FIG. 2 shows the arrangement of components in the latch 40 as the latch 40 enters the socket 20. As shown therein, the retaining dogs 60 engage the annular recess 100 in the latch body 44 to prevent downward movement of the piston 64. The retaining dogs 60 are urged into the annular recess 100 by the flange 62. The flange 62, with the accompanying shaft 56, form a trigger mechanism which maintains the piston 64 releasably disposed above the latching dogs 52 until the trigger pin 22 enters the through-bore 54 at the bottom of the lower body 44 when the latch 40 is landing in the socket 20. Sealing engagement between the trigger pin 22 and the latch body 44, after the trigger pin enters the through-bore 54, is provided by means of the seal rings 98 in the through-bore 54.

The entry of the trigger pin 22 in the bore 54 stops the downward movement of the shaft 56 as soon as contact is made therewith. However, the latch body 44 continues to move downwardly into the socket 20 until it is completely landed therein, as shown in FIG. 3. The preventing of further downward movement of the shaft 56 by the trigger pin 22 results in the flange 62 coming out of engagement with the retaining dogs 60, as shown in FIG. 3. Accordingly, the weight of the piston 64 pushes the retaining dogs 60 back into the piston body until the shoulders 60' on the dogs 60 abut the shoulders 64" on the piston body 64. Furthermore, the downward movement of the piston 64 brings the cam 64' on the piston into engagement with the cam surface 52" on the latching dogs 52 to urge the latching dogs 52 out of the lower latch body 44 and into engagement with the annular recess 30 in the socket bore 20. The outward movement of the latching dogs 52 continues until the shoulders 52' on the dogs contact the shoulders 44*b* on the lower body 44. As a result, the tendon latch 40 is latched onto the socket 20, as the final position of the piston 64, as shown in FIG. 3, prevents inward movement of the dogs 52.

The landing of the latch body 44 in the socket 20 causes water to be displaced through the vents 24 to the sea. Water adjacent the lower wedge ring 84 is exhausted through the passage 92 and the one-way valve 90 to the lower portion of the latch body 44, where it is then forced through the vents 24 to the sea.

After the latch body 44 lands in the socket 30, water is purged from the latch body 44 by forcing air through the tendon 16 to which the latch is attached and into the latch body 44. The air pushes the water through the openings 44*a* in the latch body 44 and into the socket 20. The water moves past the lower wedge ring 84 and through the one way valve 90 for passage to the sea through the vents 24.

After the water purge, oil may be passed into the latch body 44 from the tendon 16 and thereafter forced out of the body 44 by air in a manner similar to the purge of the water described above in order to provide corrosion protection. The purge of the oil will cause it to coat the exterior of the latch body 44 and the interior of the socket 20 to inhibit corrosion.

Lateral movement of the latch body 44 in the socket 20 is prevented by means of the upper and lower wedge rings 80 and 84. These gravity-based wedges 80 and 84 are driven into engagement with the upper and lower conical surfaces 26 and 28 in the socket 20 either by their own weight or by external means. A cycle bending load applied to the tendon latch 40 thereafter moves the wedges in the wedge rings 80 and 84 into tighter engagement with the socket 20 and lateral movement of the latch 40 relative to the socket 20 is prevented.

Retrieval of the latch 40, as mentioned, is done by running a tool 19 through the tendon 16 to connect to the annular groove 70 on the flanged neck 68 attached to the piston. The piston 64 is lifted by the tool 19 until the latching dogs 52 are released, thus releasing the latch itself. Thereafter, the tendon 16 and latch 40 are lifted away from the socket 20. More specifically, the lifting of the piston 64 removes the cam 64' from contact with the cam surface 52" on the latching dogs 52. Thus, the latching dogs 52 are free to move inwardly. Continued lifting of the piston 64 brings the cam 62' on the flange 62 into contact with the cam surface 60" on the retaining dogs 60 to urge the dogs 60 back into the annular recess 100 on the latch body 44 and "reset" the latch, whereupon the flange 62 again rests upon the shoulder **64*a* on the piston 64. At this point the running tool 19 is removed and the latch 40 is lifted from the socket 20 by its tendon 16. After all the tendon latches 40 have been released, the platform 10** is free to move.

As seen from the foregoing, the present invention not only provides a novel apparatus, but also provides a novel method for latching the tendons 16 run from the offshore floating platform 10 to the socket 20. The method includes running the tendon latch 40 into the socket 20, while maintaining the piston 64 releasably disposed for downward movement in the latch above the latching dogs 52. The piston is maintained in this orientation by the retaining dogs 60, which are urged into the annular recess 100 by the disk 62 attached to the shaft 56. When the shaft and disk are moved upwardly by the trigger pin 22 in the socket 20 and the latch 40 lands in the socket 20, the retaining dogs 60 are no longer maintained in engagement with the latch body 44 and thus allow the piston 64 to move downwardly. The downward movement of the piston 64 is utilized to cam the latching dogs 52 into engagement with the annular recess 30 in the socket 20. The final position of the piston 64 prevents the latching dogs 52 from moving out of engagement with the socket 20.

In the foregoing description of the present invention, a preferred embodiment of the invention has been disclosed and discussed in detail. It is to be understood that other mechanical and design variations are within the scope of the present invention. Accordingly, the invention is not limited to the particular embodiment which has been disclosed and discussed in detail herein.

What is claimed is:

1. A latch for connecting a tendon run from an offshore platform to a socket in a foundation on the sea floor comprising:

a latch body;

dog means disposed within the urgible outwardly from said body to latchingly engage said socket;

piston means, releasably disposed within said body above said dog means, for moving when released to urge said dog means outwardly from said body into latching engagement with said socket; and trigger means for releasing said piston means when said latch body lands in said socket.

2. A latch as defined in claim 3, wherein said latch further comprises:

wedge means, disposed exteriorally on said body, and axially spaced apart for wedging between said socket and said body, for inhibiting lateral movement of said body relative to said socket.

3. A latch as defined in claim 3, wherein:

said socket includes trigger pin means for activating said trigger means when said latch body lands in said socket, and annular recess means for receiving said dog means to latchingly engage said latch body to said socket; and said latch body includes internal recess means into which said piston means is latched until released by said trigger means, and through-bore means for receiving said trigger pin means into said latch body when said latch body lands on said socket.

4. A latch as defined in claim 1, wherein:

said dog means includes cam surface means for receiving said piston means when said piston means is released.

5. A latch as defined in claim 4, wherein:

said piston means includes cam means for engaging said cam surface means when said piston means is released to urge said dog means outwardly from said body into latching engagement with said socket, and support means for supporting said trigger means.

6. A latch as defined in claim 1, wherein said latch further comprises:

retaining dog means, disposed in said piston means in latching engagement with said latch body, for maintaining said piston means latched to said latch body until said piston means is released, whereupon said retaining dog means move inwardly to allow said piston means to move downwardly to engage said dog means to urge said dog means into engagement with said socket means to latch said latch body to said socket.

7. A latch as defined in claim 6, wherein said trigger means comprises:

shaft means, extending through said piston and exposed to said socket, for contacting with said trigger pin means when said latch body lands in said socket, said contact moving said shaft means upwardly; and disk means, formed on said shaft means and resting upon said piston means, for engaging said retaining dog means to maintain said retaining dog means urged outwardly from said piston means and in latching engagement with said latch body until said shaft means contacts said trigger pin means, whereupon said shaft means moves said disk means off said piston means and out of engagement with said retaining dog means, thereby releasing said piston means to move downwardly into contact with said dog means to latch said latch body to said socket.

8. A latch as defined in claim 2, wherein:

said socket includes a plurality of tapered portions of reduced diameter in the bore of said socket for engagement with said wedge means; and said wedge means includes a plurality of wedges disposed externally about said latch body to form a plurality of segmented tapered rings, said rings engaging said tapered portions in said socket to prevent lateral movement of said latch body in said socket.

9. A latch as defined in claim 2, wherein:

said socket includes vent means, communicating with the sea, for allowing displacement of fluid from said socket; and said latch further includes one-way valve means, disposed adjacent said wedge means, for directing fluid adjacent from said wedge means to said vent means.

10. An latch as defined in claim 1, wherein said latch further includes:

neck means, attached to said piston means, for releasing said latch from said socket, said neck means adapted to engage a tool run through said tendon, said tool lifting said piston means from engagement with said dog means to allow said latch to be lifted from said socket.

11. A latch for attaching a tendon run from a floating platform to a tubular socket on a subsea foundation, the bore of said socket having a plurality of annular tapered portions of reduced diameter, and said socket including trigger pin means for activating said latch, said latch comprising:

a latch body connected to said tendon and including a through-bore for receiving said trigger pin means;

latching dog means, extending through and movable outwardly from said body, for engaging said socket;

piston means, releasably disposed in the bore of said latch body, for moving downwardly when released to urge said latching dog means outwardly from said latch body;

retaining dog means, extending outwardly from and movable inwardly into said piston means, for latchingly engaging said latch body to prevent said downward movement of said pistion means until said retaining dog means are released;

trigger means, disposed in said body, for maintaining said retaining dog means biased outwardly to latchingly engage said latch body until said latch body lands in said socket, whereupon said trigger means releases said retaining dog means to allow said piston means to move downwardly to urge said latching dog means into engagement with said socket; and a plurality of wedges forming a plurality of segmented annular rings disposed about the exterior of said latch body, said tapered rings disposed to engage said annular portions of reduced diameter in said socket after said latch body has landed therein, whereby movement of said latch body in said socket is inhibited when a cycle bending load is applied to said tendon.

12. An apparatus as defined in claim 11, wherein said apparatus further includes:

removal neck means, attached to said piston means, for allowing a tool run through said tendon to latch upon and pull said piston means upwardly to release said latching dog means from engagement with said socket.

13. An apparatus as defined in claim 11, wherein:

said socket includes vent means, communicating with the sea, for allowing displacement of fluid from said socket; and said latch body includes unidirectional valve means for displacing fluid from an area adjacent said wedges to said vent means.

14. A method of attaching a tendon run from an offshore floating platform to a socket incorporating trigger means in a foundation on the sea floor, comprising:

running a latch attached to said tendon into said socket;

maintaining a piston releasably disposed for movement in said latch;

establishing contact between said latch and said trigger means to release said piston for movement; and utilizing said piston movement to move a plurality of dogs in said latch into engagement with said socket.

15. A method of inhibiting lateral movement of a latch attached to a tendon run from an offshore platform to a socket on the sea floor due to bending movement of the tendon comprising:

providing said latch with axially spaced apart exteriorally disposed wedge means; and utilizing the lateral movement of said latch in said socket after landing in said socket to allow each of said wedge means to be driven by the force of its own weight into wedging engagement between said latch and said socket, whereupon further lateral movement of said latch relative to said socket is inhibited.

16. A method of attaching a tendon run from an offshore floating platform to a socket having an upwardly disposed trigger pin in a foundation on the sea floor, said method comprising:

running a latch from said tendon into said socket;

maintaining a piston releasably disposed for downward movement in said latch by means of dogs extending through said piston into engagement with the interior of said latch;

maintaining said dogs in engagement with said latch by a disk member attached to a shaft extending downwardly through said latch;

moving said shaft and said disk upwardly by said trigger pin when said latch is landed in said socket, whereupon said dogs are no longer maintained in engagement with said latch and said piston is released to move downwardly; and utilizing said downward movement of said piston to move a plurality of latching dogs outwardly from said latch body into latching engagement with said socket.

17. A latch assembly for attaching a tendon run from a floating platform to a subsea foundation, comprising:

a tubular socket on the foundation, the bore of said socket having a plurality of axially spaced apart annular tapered portions of reduced diameter;

trigger pin means in said socket for activating said latch;

a latch body connected to said tendon and including a through-bore for receiving said trigger pin means;

latching dog means, extending through and movable outwardly from said body, for engaging said socket;

piston means, releasably disposed in the bore of said latch body, for moving downwardly when released to urge said latching dog means outwardly from said latch body;

retaining dog means, extending outwardly from and movable inwardly into said piston means, for latchingly engaging said latch body to prevent said downward movement of said piston means until said retaining dog means are released;

trigger means, disposed in said body, for maintaining said retaining dog means biased outwardly to latchingly engage said latch body until said latch body lands in said socket, whereupon said trigger means releases said retaining dog means to allow said piston means to move downwardly to urge said latching dog means into engagement with said socket.

18. A latch assembly for attaching a tendon run from a floating platform to a subsea foundation, comprising:

a tubular socket on the foundation having a pair of axially spaced apart annular tapered portions of reduced diameter;

a latch body connected to said tendon for reception in the socket;

latching dog means movably carried on said body for releasably engaging said socket to secure said body to said socket;

means, triggered by the landing of said body in said socket, for effecting latching of said latching dog means;

a plurality of wedges forming a pair of axially spaced apart annular rings disposed about the exterior of said latch body, said tapered rings disposed to engage said annular tapered portions in said socket after said latch body has landed therein, to inhibit movement of said latch body when a bending load is applied to said tendon.

* * * * *